US006359675B1

(12) United States Patent
Enon et al.

(10) Patent No.: US 6,359,675 B1
(45) Date of Patent: Mar. 19, 2002

(54) MOTION PICTURE RECORDING PROCESS AND DEVICE TO REDUCE FILMING DEFECTS

(75) Inventors: Alain M. Enon, Saint Martin S/Montaigu; Claude Peugnet, Fontaine; Olivier L. Berne, Saint-Marcel, all of (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/598,620

(22) Filed: Jun. 21, 2000

(30) Foreign Application Priority Data

Nov. 29, 1999 (FR) ..... 99 14979

(51) Int. Cl.[7] ..... G03C 11/00; B08B 1/02; B08B 3/00

(52) U.S. Cl. ..... 352/130; 134/15; 134/64 P

(58) Field of Search ..... 352/130, 72, 75, 352/38, 78 R; 134/9, 15, 64 P; 15/100; 396/513, 511, 614, 512; 242/324, 358

(56) References Cited

U.S. PATENT DOCUMENTS

| | | | | | |
|---|---|---|---|---|---|
| 1,389,082 | A | * | 8/1921 | Teitel | 15/100 |
| 1,926,981 | A | * | 9/1933 | Gould, Jr. | 15/100 |
| 2,174,660 | A | * | 10/1939 | Hirsch | 353/96 |
| 2,351,371 | A | * | 6/1944 | Smith | 355/30 |
| 3,288,027 | A | * | 11/1966 | Ruzicka | 355/75 |
| 3,640,293 | A | * | 2/1972 | Freedman | 134/9 |
| 3,778,139 | A | * | 12/1973 | Kelly | 352/130 |
| 5,337,767 | A | | 8/1994 | Ernst et al. | 134/104.1 |
| 5,423,104 | A | * | 6/1995 | West | 15/100 |
| 5,425,813 | A | | 6/1995 | Ernst et al. | 134/9 |
| 5,447,170 | A | | 9/1995 | Stein et al. | 134/64 |
| 5,561,483 | A | | 10/1996 | Johnson et al. | 352/184 |
| 5,971,311 | A | * | 10/1999 | Fujii et al. | 242/348.4 |
| 5,979,011 | A | * | 11/1999 | Miyawaki et al. | 15/308 |
| 6,091,907 | A | * | 7/2000 | Pagano | 396/207 |

FOREIGN PATENT DOCUMENTS

| | | | |
|---|---|---|---|
| EP | 0 000 064 A1 | 6/1977 | G03D/15/00 |
| EP | 0 604 331 A1 | 12/1993 | H01H/9/28 |
| EP | 0 604 334 A1 | 12/1993 | G03G/15/16 |
| EP | 0 658 828 A1 | 12/1994 | G03G/21/00 |
| GB | 1 318 220 A | 5/1973 | B32B/1/14 |

* cited by examiner

*Primary Examiner*—Russell Adams
*Assistant Examiner*—Rod Fuller
(74) *Attorney, Agent, or Firm*—David M. Woods

(57) ABSTRACT

In a motion picture recording process, filming defects are reduced by enabling the collection of particles generated over time on a film, just before the exposure of the film in the recording motion-picture camera.

6 Claims, 3 Drawing Sheets

MOTION PICTURE RECORDING PROCESS AND DEVICE TO REDUCE FILMING DEFECTS

TECHNICAL FIELD OF THE INVENTION

The present invention relates to a motion picture filming process and a device to eliminate the contamination of photographic film, which leads to filming defects.

BACKGROUND OF THE INVENTION

The imaging industry is very concerned about the quality of motion picture films. The various manipulations of the film, associated with effects due to aging, and as a result to modification of the film structure over time, lead to the conception of processes for utilizing the film in the best possible conditions.

In relation to this manipulation and aging, the removal of contamination particles on the film surface is important in many applications, such as the cleaning of photographic films utilized in image retrieval devices, in the manufacturing operations for photographic films, etc. Well-known systems for removing contamination particles from the film surface can be for instance based on the principle of compressed air blades or blade sections, or various suction systems.

U.S. Pat. Nos. 5,337,767 and 5,425,813 describe a device and its process intended to clean the film surface. The device comprises a particle transfer roller to clean the film, this roller being itself decontaminated by a system based on a bath of liquid cleaner. While drying means (waiting time between two cleanings, scraper blade) are planned, one of the disadvantages of this system is humidification of the film, by the particle transfer roller.

U.S. Pat. No. 5,447,170 describes a device for cleaning film, whose operation is based on the principle of roller vibrations, vibrations supplied by electric means, associated in part with polyurethane roller surfaces to facilitate the transfer of film particles onto them when the film is running, and in part with an improved cleaning system, consisting in running the film through a high humidity zone. One of the disadvantages of this device is the utilization of many particle transfer rollers.

U.S. Pat. No. 5,561,483 describes a system for cleaning the support surface of the film exposure aperture, mounted on a film projector or camera. The cleaning device comprises a polyurethane sheet or membrane that is applied momentarily by means of pneumatic pressure to the exposure aperture and then retracted, retaining the particles previously deposited on this film support surface. In this system, the film is not cleaned, but its support surface is exposure aperture.

European Patents 0 604 334 A1 and 0 658 828 A1 describe a material and associated processes for cleaning for example a film. The material making up the cleaner element is a polyurethane copolymerized with a charge control agent, offsetting the electrostatic phenomenon, and not migrating to the surface (risk of deposit on the cleaned surface); further, the last property improves the lifetime of the cleaning material.

SUMMARY OF THE INVENTION

The invention relates to a photographic recording process based on the principle of transferring the film particles onto a polyurethane surface, just before going in front of the exposure aperture.

The invention relates to a device for the continuous decontamination of motion picture film, just before its exposure.

In one particular embodiment, the system comprises:

- two rollers with a polyurethane external surface, intended to decontaminate the film surface;
- one rigid base support onto which the rollers are fixed; this support is fixed to the cartridge or camera body;
- one rigid closing plate that, using attachment parts, holds the rollers onto the base support.

The invention has qualitative time saving advantages and enables financial savings to be made;

- the shape of the particles will no longer appear on photographic shots, as they will be retained upstream of the exposure aperture;
- the particles generated over time on the film due for instance to a change of the emulsion will be eliminated, as the means, the object of the invention, is utilized just before the film goes in front of the exposure aperture;
- the camera downtime for cleaning will be less;
- the quality inherent costs due to later rejection of photographic prints, to the need to reshoot, to cleaning time, will be substantially less.

BRIEF DESCRIPTION OF THE DRAWINGS

Other characteristics and advantages of the invention will appear on reading the description that follows, making reference to the annexed drawings.

DETAILED DESCRIPTION OF THE INVENTION

Figure 1:
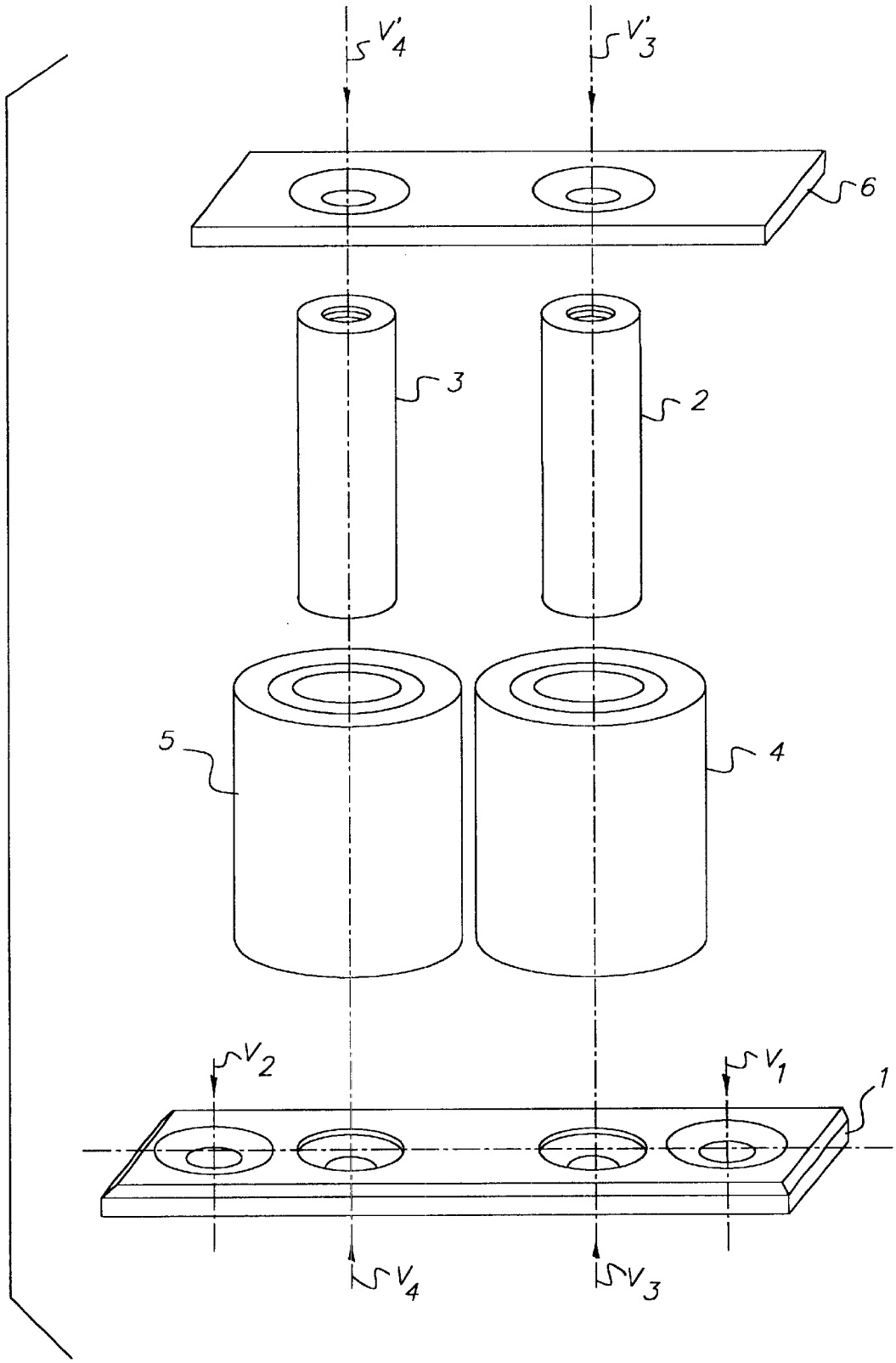
FIG. 1 is a synthetic exploded view of the assembly of the decontamination device for photographic film, without attachment parts.
Figure 2:
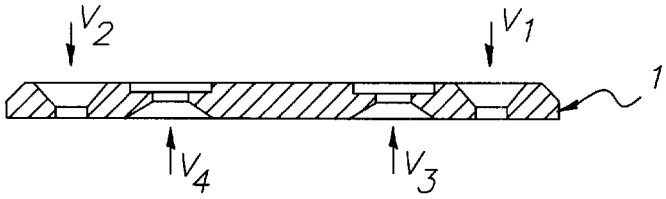
FIG. 2 represents the rollers support; this support is fixed to the cartridge or camera body.
Figure 4:
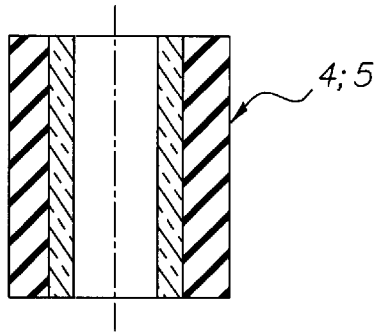
FIG. 4 represents the assembly of a decontamination roller with the central body surrounded by an external polyurethane ring.
Figure 3:
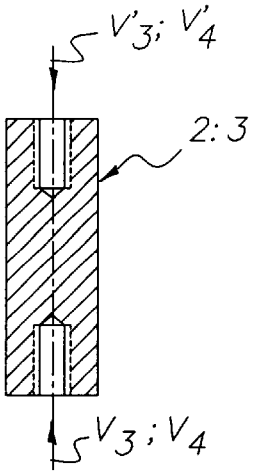
FIG. 3 represents the shafts around which the decontamination rollers turn.
Figure 5:
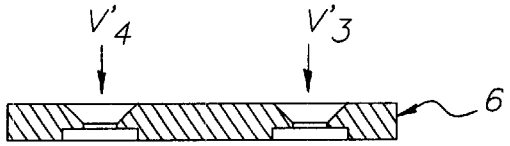
FIG. 5 represents the closing plate of the decontamination device.

The following detailed description makes reference to the attached figures in which the elements making up the invention have identical numbered markings in each figure.

When shots are made with recording motion-picture cameras 15, quality defects can arise, that is the appearance on shots of the image of visible particles, called "fluff" or exposure defect in the art, which impair the overall quality of the photography. Analyses of the problem have demonstrated that when film runs inside the camera 15, these small particles generally attached to the film edges can be deposited at the exposure aperture 20 and will of course be photographed when the film is exposed. As a result, new shots, or even complete scenes have to be redone, without however being certain that the phenomenon will not be repeated, even if the exposure aperture 20 is systematically cleaned, because these contamination particles come from the film, and thus can be deposited at the exposure aperture 20 at any time. In addition, the cost linked to this problem is substantial, because it is incurred by the shots to be redone and the repeated camera 15 cleaning operations that do not take place in overlapping time but on line, i.e. during filming.

Thus the idea had been to install in the cartridge 30 or in the recording motion-picture camera body 25, a decontamination device for photographic film; the objective of the invention being to put this device just before the film going in front of the exposure aperture 20.

Another advantage of the invention is linked to the change of the film emulsion over time: particles, not necessarily coming from the manufacturing operations, may develop and appear later, that is after the manufacturing quality controls; the device, the object of the invention will decontaminate the film just before its exposure, so that all the particles will be retained by the decontamination device, just before the exposure aperture 20.

According to the invention, a decontamination device is arranged upstream of the exposure aperture 20. This device can take the form represented diagrammatically in FIGS. 1 to 5. According to the type of motion-picture camera the device is positioned directly on the camera 15 body 25 or can be arranged inside the cartridge 30 containing the film used for filming.

The device comprises a base support 1 fixed either to the motion-picture camera body 25, or inside a motion-picture camera cartridge 30 adapted to be fixed onto the motion-picture camera 15. The support 1 is made interdependent with the cartridge 30 or camera body 25 using fixing screws (symbolized by the arrows V1 and V2). The support 1 has two extra apertures for fixing the rotation shafts 2, 3 on which the rollers 4, 5 turn. The fixing of the shafts 2 and 3 can be achieved by any appropriate means such as for example the screws symbolized by the arrows V3 and V4. Arranged on each of the shafts 2, 3 is a roller similar to that shown in FIG. 4. Each roller comprises a hard core surrounded by a layer of relatively soft polymer. The Shore A hardness of the polymer surface is between about 15 and 40 Shore A. The hard core enables the rollers 4, 5 to turn easily practically without wear around its respective shaft. The surface of the film to be exposed is brought into contact with the polymer surface of the two rollers 4, 5 just before its exposure. The costs can be reduced by using a single roller whose surface is preferably in contact with the emulsioned surface of the film.

On the ends of the shafts is fixed a closing plate 6 that prevents the rollers 4, 5 from leaving their respective shafts. The closing plate is fixed to the shafts by two screws (symbolized by the arrows V'3 and V'4).

In one particular embodiment, the material making up the support plate is Z30C13 type steel. The external holes and tapered recesses represent the holes for the countersunk fixing screws at 90°, V1 and V2. The screws fix the decontamination device assembly in the cartridge or onto the camera body 25. The internal holes represent in part the holes for the countersunk screws V3 and V4, intended to make the plate and 1 rotation shafts 2 and 3 interdependent. The cylindrical recesses shown are used to center the rotation shafts 2 and 3 in plate 1.

The rotation shafts 2 or 3, having to be able to hold steel-to-bronze dynamic friction, are preferably made of 110 daN steel with surface nitriding to a depth of 0.1 mm. The threaded holes shown are intended to take the screws V3 or V4 on the support plate 1 side, and V'3 or V'4 on the closing plate side 6.

The decontamination rollers 4 and 5 comprise an internal bronze collar that turns freely on the shafts 2 or 3. This bronze collar makes the body for the roller, it is crimped over by a polyurethane external ring with Shore A hardness between about 15 and 40. The material is chosen with ductility such that the surface is sticky, so as to retain the particles of the film 10 when it runs in contact with the polyurethane surface.

Nevertheless, note that the decontamination rotary elements must have a revolution symmetry. At least one part of these rotary elements being intended to make contact with the surface of the film strip must be obtained with a generating line having a straight or practically straight part. These elements can be cylindrical rollers, tapered rollers or another, with a practically developable zone whose width is more than the width of the film and where the generating lines are portions of straight lines or practically such portions of straight lines. The relative positioning of the rollers one with another is adapted to the film path in the filming means, so as to ensure good contact between the face of the film and the decontaminating surface of the roller(s).

The closing plate 6 can be made of Z30C13 type steel. It is intended to link the shafts 2 and 3 by means of countersunk fixing screws V'3 and V'4, which are screwed into the shafts 2 and 3. It prevents, in association with the countersunk fixing screws V'3 and V'4, the rollers 4 and 5 from leaving their respective shafts.

Figure 6:
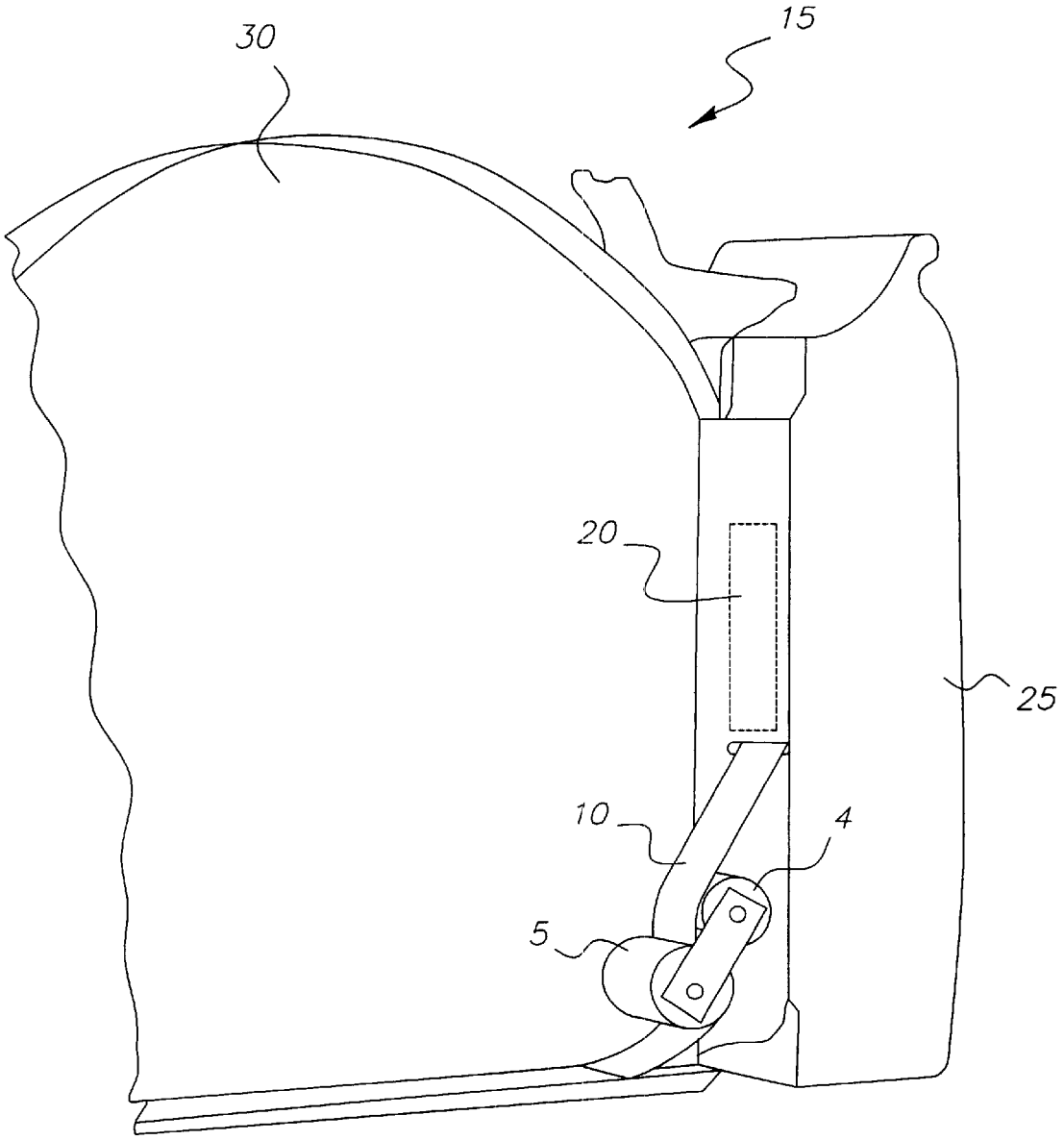
FIG. 6 represents one schematic position of the film in relation to the cleaning rollers.

FIG. 6 represents diagrammatically a decontamination device of the film 10 that can be utilized by the invention. When running, the film passes between the decontamination rollers 4 and 5. In the represented embodiment, the shafts are parallel and the rollers are cylindrical. The between-center distance of the rollers 4 and 5 is calculated so that it is more than a distance equal to the sum of the external radii of the rollers 4 and 5, plus the thickness of the film 10. The running tension of the strip is defined to generate sufficient support pressure of the film strip on the rollers 4 and 5; and further, the running kinematics of the film strip must enable sufficient development angle of the rollers 4 and 5, by the film strip, to provide a relatively large contact zone. This is in order to retain the particles of the film 10, given the respective ductility in part of the roller surfaces and in part of the film.

The utilization of a single roller, preferably in contact with the emulsioned surface of the film strip can eliminate most of the particles or debris likely to become attached to the edges of the exposure aperture 20. The utilization of two rollers provides complete decontamination of the film 10, on both sides of the film strip, just before it goes in front of the exposure aperture 20 decontamination in part of the emulsioned side and in part of the non-emulsioned side. The placing of the device assembly in the cartridge 30 or on the camera body 25 is planned so that the running kinematics ensure correct tension of the film 10, on the emulsioned surface and the non-emulsioned surface; according to the type of camera 15 utilized.

EXAMPLES

The results of the first tests carried out on a total of 129 strips run in a motion-picture camera, with and without integration of the decontamination device, demonstrated the effectiveness of this invention, by the results obtained.

Out of the 93 film strips run without the decontamination device, 25 of them, i.e. near 30%, produced comments: hair or "fluff" in the exposure aperture.

Out of the 36 film strips run with the decontamination device comprising polyurethane decontamination rollers, no film produced particles in the camera exposure aperture.

The invention has been described with reference to its preferred representation, but it is understood that alternatives especially for the materials, dimensions and shapes utilized, or even modifications, can be used or made in the spirit and scope of the claimed invention. Therefore the disclosed representation illustrates the invention and is not restrictive. The scope of the invention is given by means of the attached claims, and all the alternatives entering into this scope will be covered by the claims.

Also for instance if the film composition allows it, the envelopment of the film on the two rollers can be changed by closing up these rollers, so as to exert a slight pressure by the rollers on the film, in order to transfer the particles onto these rollers, without damaging the film.

Also for example quick means can be provided to remove the decontamination device in order to clean or replace the polyurethane rollers more quickly.

The invention has been described in detail with particular reference to certain preferred embodiments thereof, but it will be understood that variations and modifications can be effected within the spirit and scope of the invention.

We claim:

1. A method for cleaning a photographic film strip during a motion picture recording process, said method comprising the steps of:

passing an unexposed photographic film strip through an exposure aperture in a motion picture camera where an image is recorded on the film strip; and cleaning the unexposed photographic film strip just before it passes through the exposure aperture by putting one surface of said film strip in continuous contact with an external surface of at least one rotary element just before the film strip passes through the exposure aperture, said element having a revolution symmetry and whose generating lines are practically straight, the external surface of this element having a Shore A hardness between 15 and 40.

2. The recording process of claim 1, wherein two rotary elements are utilized, each one being in contact with a different side of the film strip.

3. A recording motion picture camera comprising:

means for supplying an unexposed photographic film strip along a film path within the camera;

an exposure aperture arranged in the film path for exposing the unexposed photographic film strip to image light; and a decontamination device placed along the film path just before the exposure aperture, wherein said decontamination device comprises a polyurethane roller of Shore A hardness from 15 to 40, said roller being interdependent with a collar itself turning on a shaft fixed on a mechanical support and intended to be in contact with one side of the film strip arranged in the motion picture camera.

4. The camera of claim 3, wherein said means for supplying the unexposed photographic film strip comprises a camera cartridge, and wherein the mechanical support is situated within the camera cartridge for supporting the decontamination device.

5. The camera of claim 3, further comprising a camera body on which the mechanical support is situated for supporting the decontamination device.

6. The camera of claim 3, wherein the decontamination device comprises a second polyurethane roller, Shore A hardness from 15 to 40, interdependent with a collar, itself turning on a shaft fixed on the mechanical support and intended to be in contact with the other surface of the film strip just before the exposure aperture.

* * * * *